US005772284A

United States Patent [19]

Lindsey et al.

[11] Patent Number: 5,772,284

[45] Date of Patent: Jun. 30, 1998

[54] MULTIPURPOSE HORIZONTAL SURFACE STRIPPER

[75] Inventors: Stephen B. Lindsey, Mesquite; Randy D. Lindsey, Dallas, both of Tex.

[73] Assignee: Blast Off Floor Preparation, Inc., Mesquite, Tex.

[21] Appl. No.: 717,228

[22] Filed: Sep. 26, 1996

[51] Int. Cl.[6] ..... B32B 31/18; E21C 47/00

[52] U.S. Cl. ..... 299/36.1; 15/93.1; 30/170; 299/37.1

[58] Field of Search ..... 299/36.1, 37.1, 299/37.3; 30/170; 15/93.1

[56] References Cited

U.S. PATENT DOCUMENTS

| | | | |
|---|---|---|---|
| 4,053,958 | 10/1977 | Taylor | 15/93.1 |
| 4,394,052 | 7/1983 | Adams et al. | 299/18 |
| 4,504,093 | 3/1985 | Grasse | 299/37.1 |
| 5,002,629 | 3/1991 | Nakamura | 156/584 |
| 5,037,160 | 8/1991 | Ukai | 299/37.1 |
| 5,082,330 | 1/1992 | Holder | 299/37.1 |
| 5,197,784 | 3/1993 | Holder | 299/37.1 |
| 5,409,299 | 4/1995 | Holder | 299/41.1 |
| 5,452,943 | 9/1995 | Campbell | 299/39.3 |
| 5,641,206 | 6/1997 | Craft | 299/37.1 |

*Primary Examiner*—David J. Bagnell
*Attorney, Agent, or Firm*—Steven W. Smith

[57] ABSTRACT

A multipurpose surface stripper apparatus is provided for removing surface coverings, linoleum, tile, or carpet from a supporting surface, floor or deck. The apparatus includes a chassis having a frame, a stripping assembly, a drive assembly, and a hydraulic system for controlling the operation of the stripping and drive assemblies. The stripping assembly includes a stripping blade, a blade mount, at least one carrier bearing fixably mounted to a supporting plate, and a roll axle extending through the carrier bearing for changing the roll of the blade. The axle has one end fixably connected to a lower surface of the blade mount and a second end connected to the stationary end of a pitch control hydraulic cylinder. The carrier bearing supporting plate is mounted between the blade mount and the front end of the frame. The carrier bearing changes the roll and pitch of the blade with respect to the supporting surface to allow the edge of the blade to adjust to the surface contours, adhesive deposits, and similar surface imperfections.

16 Claims, 4 Drawing Sheets

MULTIPURPOSE HORIZONTAL SURFACE STRIPPER

BACKGROUND OF THE INVENTION

1. Field of the Invention

This invention relates to horizontal surface strippers and, more particularly, to an apparatus for removing covering from a supporting surface or floor such as carpet, linoleum, vinyl or ceramic tile.

2. Description of Related Art

Motor or hand-propelled devices for removing covering from horizontal surfaces such as floors and decks are well known. These devices typically include a blade which is wedged between the supporting surface and the covering to be removed. As the apparatus moves forward, the blade strips the covering from the surface. The capability of the apparatus to adjust to irregularities in the contour of the surface influences the efficiency of covering removal. These contours may include pits, grooves, or adhesive residue. Although some devices known in the art purport to adjust to the changing contours of the supporting surface, their use in the field has not been satisfactory. The stripping blades of these prior art devices jump or slip out of operating position onto the top of the covering sought to be removed. As the speed of the stripping operation increases, the frequency of blade slippage over even minor contours increases.

Although there are no known prior art teachings of a solution to the aforementioned deficiency, a number of prior art references exist that discuss subject matter that bears some relation to the information disclosed herein. Such prior art references are U.S. Pat. Nos. 4,394,052; 4,504,093; 5,002,629; 5,037,160; 5,082,330; 5,197,784; and 5,409,299. Each of these references is discussed briefly below.

U.S. Pat. No. 4,394,052 to Adams relates to an apparatus for removing carpet that has been glued to a surface. The apparatus includes a blade having a knife at each end. During operation, the blade is wedged beneath the carpet and the knives are used to cut the carpet to a convenient handling width for automatic rolling onto a carpet take-up spool.

U.S. Pat. No. 4,504,093 to Grasse relates to a power-operated floor stripping apparatus. The cutting blade of Grasse '093 is rigidly mounted onto a blade shoe which is adjustably held against a cutting head. The angle of the cutting blade is preset such that during operation, a steeper angle of the blade in relationship to the floor causes the blade to dig deeper into the floor. In addition, the length of the blade extending from the shoe and the weight applied to the cutting edge are variable to accommodate removal of different flooring types.

U.S. Pat. No. 5,002,629 to Nakamura relates to a motor-powered floor covering peeling vehicle. The peeling blade of '629 is moved back and forth over the floor surface by a thrusting means so that the cutting edge of the blade is sequentially inserted between the floor surface and its covering.

U.S. Pat. No. 5,037,160 to Ukai relates to a flooring remover apparatus wherein the angle of the cutting blade is controlled by an oil pump and a drive shaft. In particular, the blade is moved up and down by oil cylinders and forward and backward by means of a driving shaft.

U.S. Pat. No. 5,082,330 to Holder relates to an apparatus for removing floor covering wherein the frame and blade of the apparatus are structurally independent from the hydraulic fluid pump used for powering the apparatus. U.S. Pat. No. 5,197,784 to Holder is a continuation in part of '330, wherein the blade tool of the apparatus may pivot along an axis generally perpendicular to the frame.

Each of the above prior art references requires that the pitch of the cutting blade in relationship to the surface be manually adjusted by the operator in a fixed relationship to the surface. Therefore, minor changes in the contours of the supporting surface still cause the stripping blade to skip or jump over the surface covering. The operator must then reposition the apparatus, as well as the cutting assembly before continuing the stripping operation.

Although blade slippage caused by contours in the underlying supporting surface has been recognized in the art, attempts to solve the problem have not been successful. For example, U.S. Pat. No. 5,409,299 to Holder relates to a rotary cutting attachment for use on a floor covering removal apparatus such as those disclosed in '330 and '784. The cutter attachment of '299 includes an elastomeric ring disposed between the drive plate and cutter head purportedly for enabling the cutter assembly to conform to the contour of the surface being stripped. The inclusion of an elastomeric ring in the cutter assembly of '299, however, falls substantially short of eliminating the problem it was designed to address.

Stripping assemblies known in the prior art have neither eliminated the slippage nor decreased it to a non-obtrusive level. When using any of the known prior art devices, additional operating time is required to repeatedly reposition the apparatus and stripping assembly such that the blade properly rests between the supporting surface and the covering. Therefore, it would be a distinct advantage to have an stripping apparatus and cutting assembly which facilitates conformation of the blade to the changing contours of the supporting surface and substantially decreases or eliminates blade slippage during operation.

SUMMARY OF THE INVENTION

In accordance with the present invention, a multipurpose surface stripper apparatus is provided for removing covering, such as linoleum, tile, or carpet from a supporting surface. It is an object of the present invention to provide a surface stripping apparatus wherein the scraping or cutting blade automatically adjusts its roll in relationship to contours in the supporting surface to increase the efficiency of the stripping operation. Specifically, this blade adjustment mechanism virtually eliminates blade slippage and the time needed to reposition the apparatus and blade between the supporting surface and its covering before the stripping operation can commence.

In one aspect of the invention, the stripping assembly includes a frame, a blade mount connected to the frame, a stripping blade mounted on the blade mount, and a means for changing the roll of the blade with respect to the supporting surface to allow the edge of the blade to adjust to the surface contours, adhesive deposits, and similar surface imperfections. In another aspect of the present invention, the stripping assembly includes a means for changing the pitch of the blade with respect to the supporting surface.

In a preferred embodiment of the present invention, the means for changing the roll of the blade includes a carrier bearing fixably mounted to a supporting plate, and a roll axle extending through the carrier bearing. The axle has one end fixably connected to a lower surface of the blade mount and a second end connected to the frame. In one configuration, the roll axle extends through a plurality of carrier bearings and the carrier bearing supporting plate is mounted between the blade mount and the front end of the frame.

In another preferred embodiment of the present invention, an apparatus for stripping covering from a supporting surface is provided including a chassis having a frame, a stripping assembly, a drive assembly, and a hydraulic system for controlling the operation of the stripping and drive assemblies. In one embodiment, the stripping assembly is attached to the front end of the chassis frame, and includes a stripping blade, a blade mount, and a means for changing the pitch and roll of the blade.

In one embodiment of the present invention, the drive assembly of the stripping apparatus includes left and right drive wheels. Each drive wheel has a drive motor and control lever for changing its directional rotation to facilitate steering of the apparatus. The drive assembly may include a caster wheel which pivots between a raised position and a lowered position. In its raised position, the caster wheel clears the supporting surface, and in its lowered, surface contacting position, the caster wheel and frame hold the stripping assembly above the supporting surface. In yet another embodiment, a control lever and hydraulic cylinder are provided for pivoting the caster wheel. The hydraulic cylinder preferably has a first end fixably mounted on the chassis and a retractable second end connected to the caster wheel.

In another embodiment of the present invention, a pitch adjustment mechanism is provided including a pitch control lever and a pitch hydraulic cylinder having a first end fixably mounted to the chassis and a retractable second end connected to an upper surface of the blade mount.

It is an object of the pitch adjustment mechanism to change the angle of the blade within the range of substantially vertical to substantially horizontal with respect to the supporting surface, from approximately 90 to 180 degrees. Similarly, it is an object of the roll adjustment mechanism to permit the edge of the scraper blade to conform to the contours of the supporting surface.

In one aspect, the roll adjustment mechanism includes one or more carrier bearings fixably mounted to a supporting plate, and a roll axle extending through the carrier bearings. In this configuration, the roll axle has a first end fixably connected to a lower surface of the blade mount and a second end connected to a supporting means such as the chassis frame.

BRIEF DESCRIPTION OF THE DRAWINGS

The invention will be better understood and its numerous objects and advantages will become more apparent to those skilled in the art by reference to the following drawing, in conjunction with the accompanying specification, in which.

DESCRIPTION OF THE PREFERRED EMBODIMENTS

Figure 1:
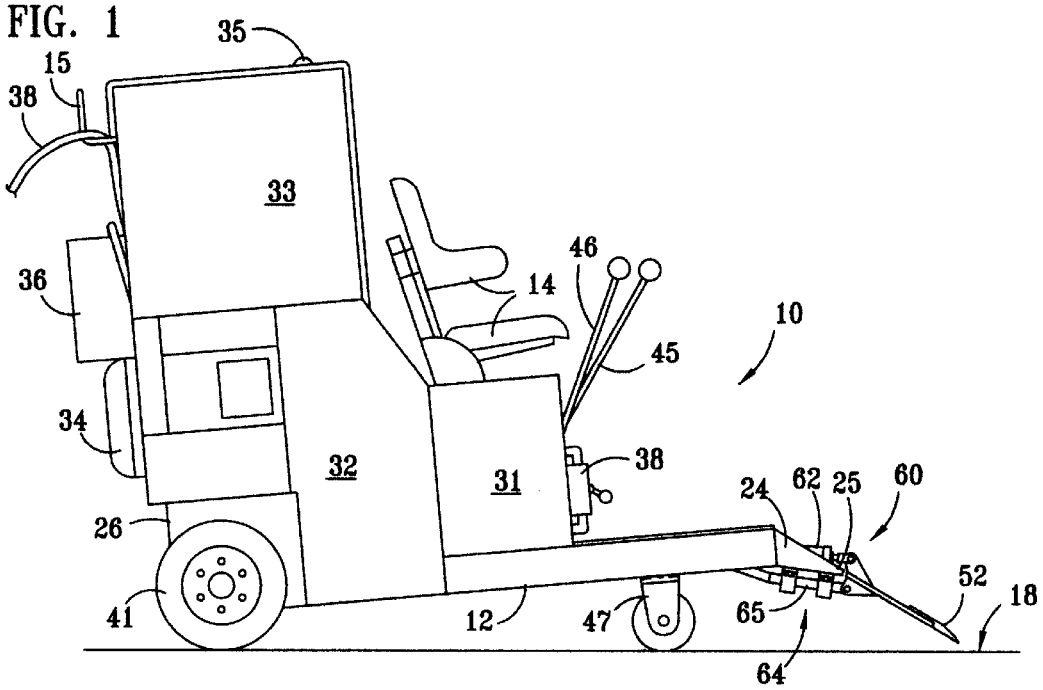
FIG. 1 is a right side elevation view of one preferred embodiment of the surface stripper of the present invention.
Figure 5:
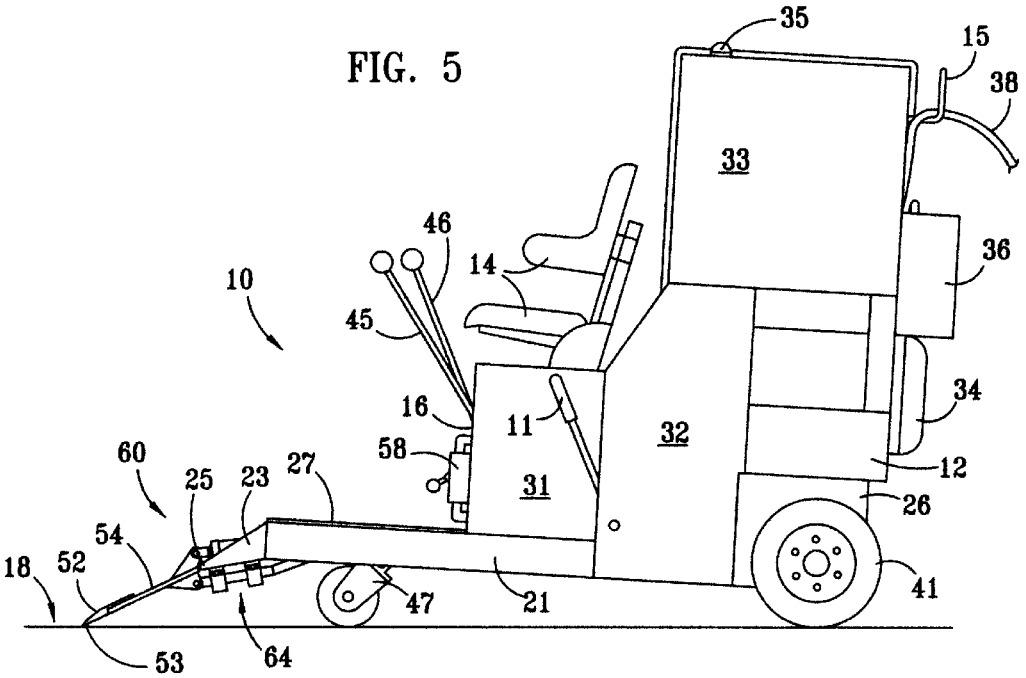
FIG. 5 is a left side elevation view of the surface stripper of the present invention shown in FIG. 1.

Referring to FIGS. 1 and 5, stripper apparatus 10 preferably comprises chassis 12, a stripping assembly a, drive assembly, a hydraulic system, operator seat 14. Chassis 12 includes a frame having front end 25, back end 26, left side 21, right side 22, and left and right front end supports 23, 24.

Figure 2:
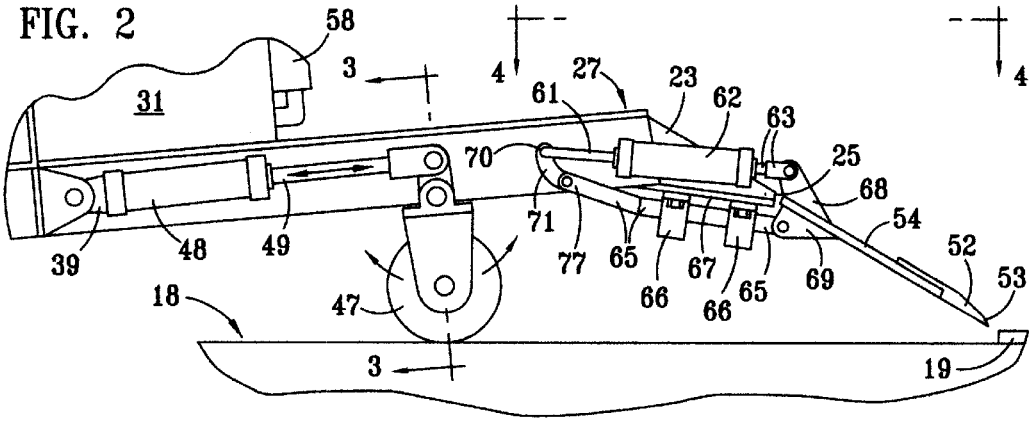
FIG. 2 is a detailed right side elevation view of the front end of the present invention shown in FIG. 1, depicting the stripping assembly in a raised position.
Figure 3:
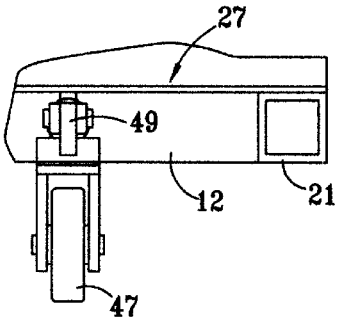
FIG. 3 is a cross-sectional view of the rotatable blade adjustment wheel of the surface stripper taken along line 3—3 of FIG. 2.
Figure 6:
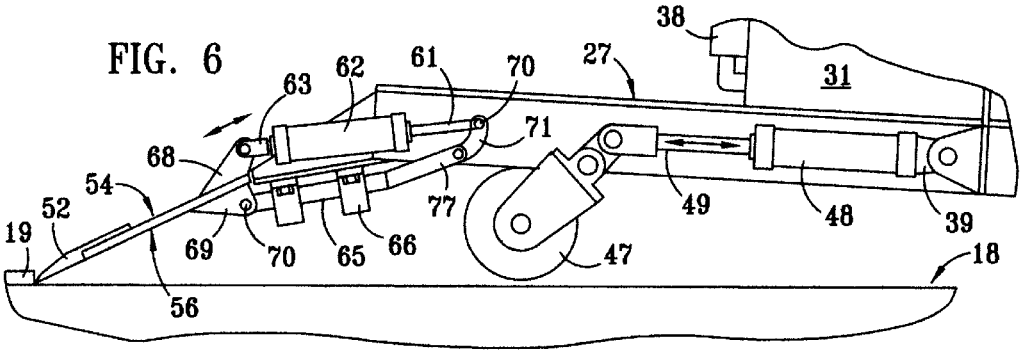
FIG. 6 is a detailed left side elevation view of the front end of a preferred embodiment of the invention, depicting the stripping assembly in a lowered position having the blade in contact with the surface covering.

As shown in FIGS. 1, 5, 8 and 9, the drive assembly preferably comprises left and right drive wheels 41, 42, drive motors 43, 44 and drive wheel control levers 45, 46 mounted on control panel 16. Control levers 45, 46 are used to control the directional rotation of the wheels, permitting forward and reverse rotation of the wheels 41, 42. Caster wheel 47 is centrally located near the front end 25 of the frame. As shown in FIGS. 1 and 2, caster wheel 47 is in its lowered position, wherein it supports front end 25 when the stripping assembly is raised above supporting surface or floor 18. Caster wheel 47 is pivoted to its raised position, as shown in FIGS. 5 and 6 during operation of the stripping assembly. For optimal performance, wheel 47 clears surface 18 during operation of apparatus 10 such that the weight of front end 25 applies additional force and thrust on blade 52 during operation of stripping assembly.

Figure 11:
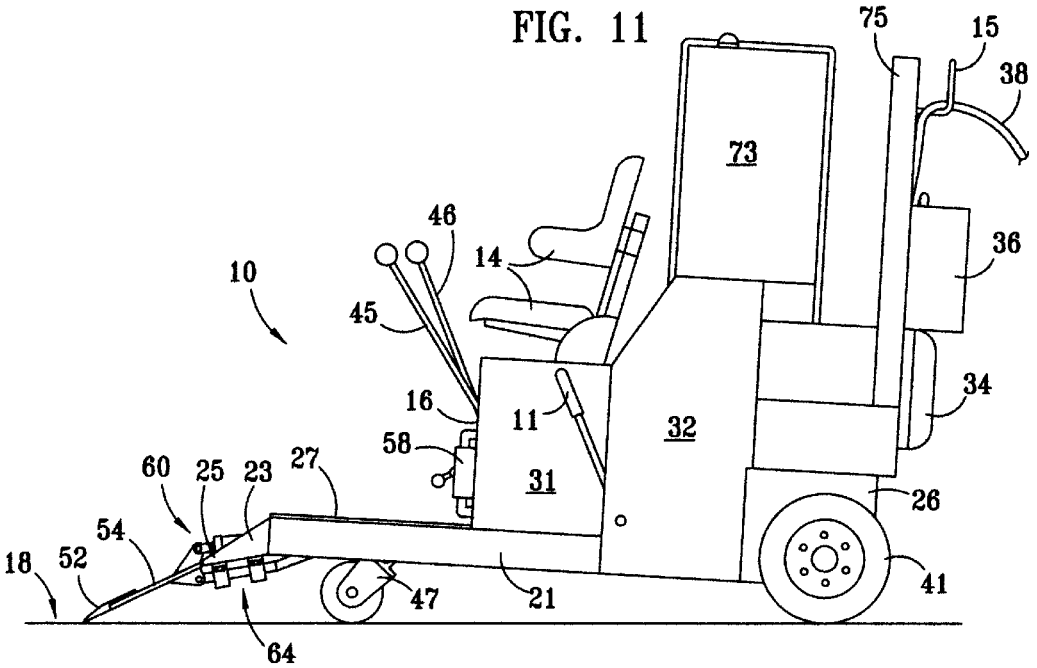
FIG. 11 is left side elevation view of an alternative embodiment of the surface stripper of the present invention.

Referring to FIGS. 1 and 5, the hydraulic system preferably includes pump 31, valve control unit 32, and oil tank 33 having an inlet valve 35. As shown in FIG. 11, an alternative embodiment of the hydraulic system is shown including oil cooling tank 73, a smaller unit which permits the addition of a storage rack 75 at rear end 26 of chassis 12. Referring back to FIGS. 1 and 5, the hydraulic system is powered by a standard motor 34, such as combustion engine or electric motor. As shown in the drawings, motor 34 is a twenty-five horse power electric motor in connection with an external power supply (not shown) through electrical starter box 36, electrical power cable 38 and power cable holder 15.

Referring to FIGS. 1–7, the stripping assembly includes blade 52 having a scraping and cutting edge 53, a blade mount 54 attached to a supporting means such as the frame of chassis 12, and means for adjusting the pitch and the roll of the blade. In a preferred embodiment, the means for adjusting the pitch of the blade with respect to the supporting surface 18, along an axis transverse to the frame of chassis 12 includes a pitch control lever 58 on control panel 16 and a pitch hydraulic cylinder 62 having a first end 61 connected to mount 71 and a retractable second end 63 connected to the upper surface 55 of blade mount 54 with cylinder mount 68.

Figure 10:
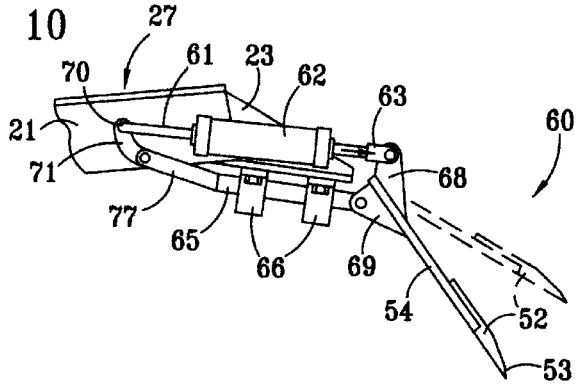
FIG. 10 is a detailed right side elevation view of the stripping assembly of the present invention depicting the stripping blade in a lowered position, substantially vertical to the supporting surface, with the raised position of the blade being shown in phantom.

As shown in FIG. 10, during operation of the apparatus 10 and stripping assembly, the pitch of blade 52 is manually adjusted as needed depending on the materials of the supporting surface 18, covering 19 and adhesive (not shown)

therebetween using pitch control mechanism 60. Moving pitch control lever 58, end 63 of hydraulic cylinder 62 extends and retracts to change the position of blade 52 with respect to supporting surface 18 through a range of angles from substantially vertical through substantially horizontal to supporting surface 18.

Figure 4:
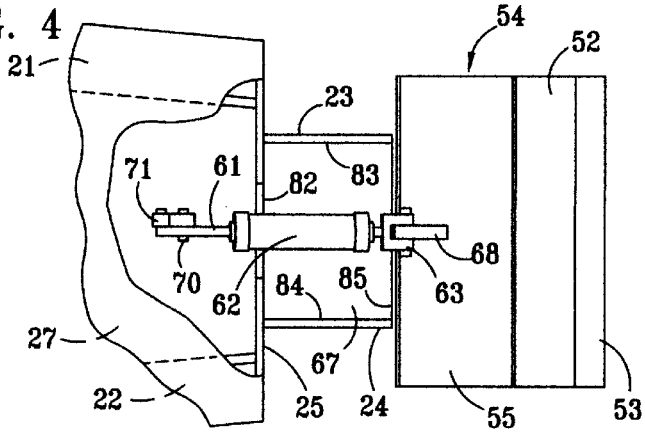
FIG. 4 is a top plan view, partially broken away, of the stripping assembly taken along line 4—4 of FIG. 2.
Figure 7:
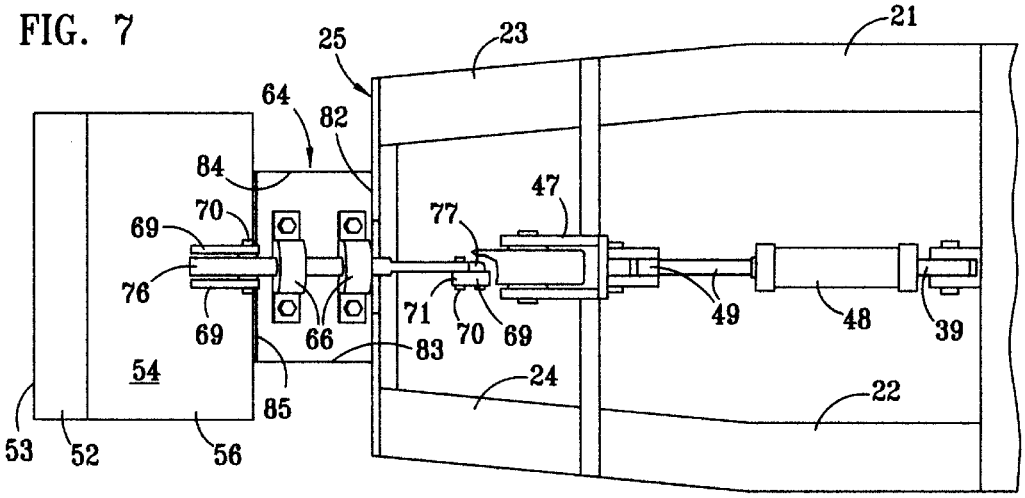
FIG. 7 is a partial bottom plan view of the stripping assembly in accordance with the teachings of the present invention.
Figure 8:
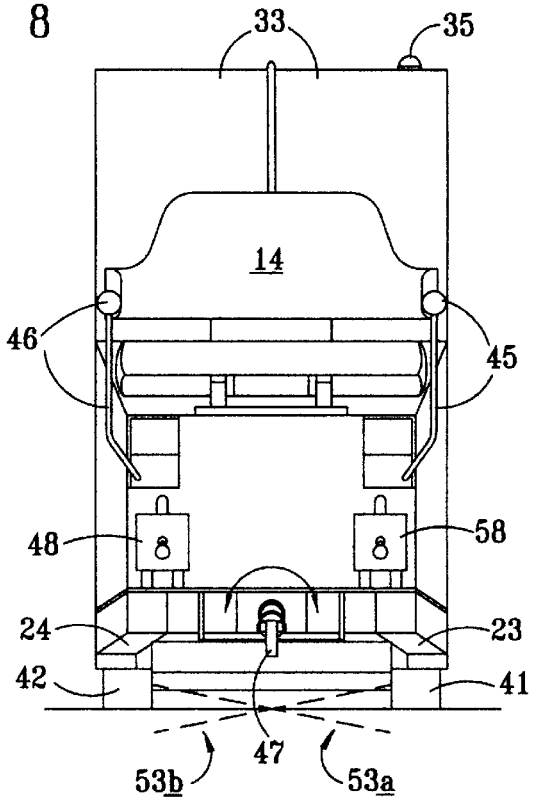
FIG. 8 is a front elevation view of the surface stripper of the present invention shown in FIG. 1.
Figure 9:
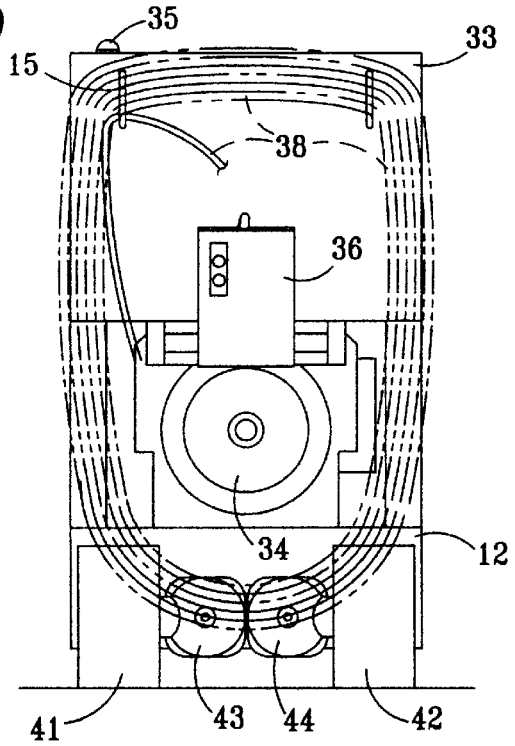
FIG. 9 is a rear elevation view of the surface stripper of the present invention shown in FIG. 1.

Referring to FIGS. 4, 7, and 8, the roll of blade 52 automatically adjusts to contours, adhesive deposits and imperfections in supporting surface 18 during operation of the stripping assembly. Roll adjustment mechanism 64 includes at least one carrier bearing 66 fixably mounted to supporting plate 67, and a roll axle extending through bearing(s) 66. Supporting plate 67 is welded on three sides 82, 83, and 84 to front end 25 and rail supports 23, 24. Side 85 of support plate 67 is adjacent to blade mount 54.

The first end 76 of axle 65 is fixably connected to a lower surface 56 of blade mount 54. The second end 77 is connected to stationary end 61 of hydraulic cylinder 62 using roll mechanism mount 71 and bolts 70. Suitable carrier bearings known in the art include carrier bearings manufactured by bearing companies BCA, SKF and Fafiner. When solidly mounted on supporting plate 67, carrier bearings 66 enable axle 65 to rotate slightly, changing the roll of blade 52 with respect to the supporting surface 18.

For example, during operation of the stripping assembly, the carrier bearings 66 and mount 71 at end 77 permit a slight rotation of axle 65 when surface 18 irregularities are encountered. The slight rotation or shifting of axle 65 within carrier bearings 66 enables the cutting edge 53 of blade 52 to adjust to the changing contours of surface 18, as shown by 53*a* and 53*b* in FIG. 8. This automatic blade 52 roll adjustment along the longitudinal axis of the frame during operation virtually eliminates blade slippage such as commonly encountered in prior art stripping devices. The absence of slippage eliminates the down time needed to reposition the stripping apparatus and cutting blade between surface 18 and covering 19.

With continuing reference to FIGS. 1–11, operation of the stripping apparatus of the invention will now be described. With the caster wheel 47 in its lowered, surface contacting position, blade 52 is raised above supporting surface 18 to permit free movement and steering of apparatus 10. Once the apparatus 10 is in place, hydraulic cylinder 48 is activated to raise caster wheel 47 and lower the stripping assembly such that blade 52 is in contact with surface 18. Next, the pitch of blade 52 with respect to supporting surface 18 may be manually preset within a range of motion from approximately a ninety degree to one-hundred eighty degree angle to wedge scraping edge 53 between supporting surface 18 and covering 19. It will be known and understood by those skilled in the art that the operator may manually change the pitch of the blade 52 during operation of the apparatus 10 as needed.

The removal of covering 19 from surface 18 is achieved by the forward thrust of the blade scraping edge 53 between surface 18 and covering 19. As irregularities are encountered in the surface 18, automatic roll adjustment mechanism 64 permits a slight rotation of axle 65 such that scraping edge 53 remains wedged underneath covering 19 and the stripping operation continues without interruption.

It will become apparent to those skilled in the art that use of the present invention in standard stripping operations substantially increases the efficiency of the stripping process and the operator's productivity. Prior art devices, such as those referenced above, quote a stripping coverage of approximately 18,000 square footage per day. Using the present invention described and claimed herein, an operator can strip approximately 40,000 square footage of covering from a surface per day, removing an average of 5000 to 7500 square feet of covering per hour.

It is thus believed that the operation and construction of the present invention will be apparent from the foregoing description. While the apparatus and stripping assembly shown and described have been characterized as being preferred, it will be readily apparent that various changes and modifications could be made therein without departing from the spirit and scope of the invention as defined in the following claims.

What is claimed is:

1. An apparatus for stripping covering from a supporting surface, comprising:

a chassis having a frame, said frame having a front end, a back end, a left side, and a right side;

a stripping assembly attached to the front end of the frame, said stripping assembly having a stripping blade, a blade mount, and a means for changing the position of the blade, said means for changing the position of the blade further comprising a manual pitch adjustment mechanism and an automatic roll adjustment mechanism;

a drive assembly connected to the frame for moving the frame and stripping assembly over the supporting surface; and a hydraulic system for controlling the operation of the stripping and drive assemblies.

2. The stripping apparatus of claim 1, wherein the pitch adjustment mechanism comprises a pitch control lever and a pitch hydraulic cylinder having a first end fixably mounted to a support means and a retractable second end connected to an upper surface of the blade mount.

3. The stripping apparatus of claim 2, wherein the support means of the first end of the pitch hydraulic cylinder is a first end of a bearing axle.

4. The stripping apparatus of claim 1, wherein the pitch adjustment mechanism changes the angle of the blade along a transverse axis within a range of substantially vertical to substantially horizontal with respect to the supporting surface.

5. The stripping apparatus of claim 1, wherein the roll adjustment mechanism permits a scraper edge of the blade to conform to the contours of the supporting surface.

6. The stripping apparatus of claim 1, wherein the roll adjustment mechanism comprises a carrier bearing fixably mounted to a supporting plate, and a roll axle extending through said carrier bearing, said axle having a first end fixably connected to a lower surface of the blade mount and a second end connected to a supporting means.

7. The stripping apparatus of claim 6, further comprising a plurality of carrier bearings.

8. The stripping apparatus of claim 6, wherein said supporting means of the second end of the axle is a first end of a pitch hydraulic cylinder.

9. The stripping apparatus of claim 1, wherein said chassis further comprises an operator seat.

10. The stripping apparatus of claim 1, wherein said drive assembly further comprises:

left and right drive wheels mounted near the back end of the frame, each said drive wheel having a drive motor and a drive wheel control lever, wherein said drive wheel control lever changes the directional rotation of said wheel;

a caster wheel near the front end of the frame; and a means for pivoting the caster wheel between a raised position and a lowered position;

wherein said caster wheel clears the supporting surface in its raised position, and supports the stripping assembly above the supporting surface in its lowered position.

11. The stripping apparatus of claim 10, wherein said means for pivoting the caster wheel comprises a caster wheel control lever and a caster wheel hydraulic cylinder, said caster wheel hydraulic cylinder having a first end fixably mounted on the chassis and a retractable second end connected to the caster wheel.

12. A stripping assembly for removing covering from a supporting surface, comprising:

a frame;

a blade mount connected to the frame;

a stripping blade mounted on the blade mount, said stripping blade having a scraper edge; and a means for automatically allowing the roll of the blade to change with respect to the supporting surface to allow the edge of the blade to adjust to the contour of the supporting surface.

13. The stripping assembly of claim 12, further comprising a means for changing the pitch of the blade with respect to the supporting surface.

14. A stripping assembly for removing covering from a supporting surface, comprising:

a frame;

a blade mount connected to the frame;

a stripping blade mounted on the blade mount, said stripping blade having a scraping edge; and a means for allowing the roll of the blade to change with respect to the supporting surface to allow the edge of the blade to adjust to the contour of the supporting surface, said means comprising a carrier bearing fixably mounted to a supporting plate;

and a roll axle extending through said carrier bearing, said axle having a first end fixably connected to a lower surface of the blade mount.

15. The stripping assembly of claim 14, further comprising a plurality of carrier bearings.

16. The stripping assembly of claim 14, wherein the carrier bearing supporting plate is mounted between the blade mount and a front end of the frame.

* * * * *